US009318025B2

(12) United States Patent
Conner et al.

(10) Patent No.: US 9,318,025 B2
(45) Date of Patent: Apr. 19, 2016

(54) GROUND OBSTACLE COLLISION ALERT DEACTIVATION

(71) Applicant: Honeywell International Inc., Morristown, NJ (US)

(72) Inventors: Kevin J Conner, Kent, WA (US); Tomas Marczi, Beroun (CZ); Christine Marie Haissig, Chanhassen, MN (US); John Howard Glover, Redmond, WA (US)

(73) Assignee: Honeywell International Inc., Morris Plains, NJ (US)

( * ) Notice: Subject to any disclaimer, the term of this patent is extended or adjusted under 35 U.S.C. 154(b) by 80 days.

(21) Appl. No.: 14/109,093

(22) Filed: Dec. 17, 2013

(65) Prior Publication Data

US 2015/0170525 A1 Jun. 18, 2015

(51) Int. Cl.
*G08G 5/00* (2006.01)
*G08G 5/06* (2006.01)

(52) U.S. Cl.
CPC ..... *G08G 5/0021* (2013.01); *G08G 5/0073* (2013.01); *G08G 5/06* (2013.01); *G08G 5/065* (2013.01)

(58) Field of Classification Search
CPC ..... G08G 5/0086; G08G 5/04; G08G 5/00
USPC ..... 701/301, 3, 9, 117, 16; 340/945, 947, 340/951, 963
See application file for complete search history.

(56) References Cited

U.S. PATENT DOCUMENTS 6,606,563 B2 8/2003 Corcoran, III
7,117,089 B2 10/2006 Khatwa et al.
7,414,545 B2 * 8/2008 Vickas ..... G08G 1/166 340/901
7,587,278 B2 * 9/2009 Poe ..... G08G 5/0008 340/961
7,783,427 B1 * 8/2010 Woodell ..... G01S 7/003 340/961
8,019,529 B1 * 9/2011 Sharma ..... G08G 5/06 701/117
8,478,461 B2 * 7/2013 Khatwa ..... G08G 5/025 701/120
8,890,718 B2 * 11/2014 Block ..... G08G 5/0086 340/945
2004/0225440 A1 11/2004 Khatwa et al.
2008/0109163 A1 5/2008 Stone et al.
2011/0276201 A1 * 11/2011 Block ..... G08G 5/0086 701/9
2012/0200433 A1 * 8/2012 Glover ..... G08G 5/065 340/971

(Continued)

OTHER PUBLICATIONS

Extended Search Report from counterpart European Application No. 14193962.9, dated Apr. 22, 2015, 9 pp.

(Continued)

*Primary Examiner* — Thomas G Black
*Assistant Examiner* — Wae Louie
(74) *Attorney, Agent, or Firm* — Shumaker & Sieffert, P.A.

(57) ABSTRACT

In some examples, a processor is configured to control a ground obstacle collision alerting system of an aircraft to deactivate delivery of ground obstacle collision alerts in response to determining the aircraft is in a designated ground area. In some examples, the processor is configured to determine the aircraft is in the designated ground area based on user input, based on a geographic location of the aircraft, or both. The processor is further configured to control the ground obstacle collision alerting system to automatically reactivate the delivery of the ground obstacle collision alerts in response to determining the aircraft is outside of the designated ground area. In some examples, the processor is configured to determine the aircraft is outside of the designated ground area based on a geographic location of the aircraft, a ground speed of the aircraft, or both.

20 Claims, 2 Drawing Sheets

(56) References Cited

U.S. PATENT DOCUMENTS

| | | | | |
|---|---|---|---|---|
| 2015/0170525 | A1* | 6/2015 | Conner | G08G 5/065 701/3 |
| 2015/0206439 | A1* | 7/2015 | Marsden | G08G 5/025 701/301 |

OTHER PUBLICATIONS

Response to the Communication pursuant to Rules 70(2) and 70a(2) EPC from counterpart European Application No. 14193962.9, dated Dec. 11, 2015, 25 pp.

* cited by examiner

GROUND OBSTACLE COLLISION ALERT DEACTIVATION

TECHNICAL FIELD

The disclosure relates to aircraft alerts.

BACKGROUND

Some aircraft are equipped with a ground obstacle collision alerting system used during ground operations to help the aircraft stay apprised of potential collisions, e.g., with another aircraft or another object. The ground obstacle collision alerting system is configured to generate alerts indicative of potential collisions between the aircraft and an obstacle while the aircraft is on the ground. For example, the system may generate an alert in response to determining an object on the ground is within a particular distance of the aircraft on which the system is mounted.

SUMMARY

The disclosure describes example ground obstacle collision alerting systems that can be used during ground operations to help an aircraft stay apprised of potential collisions between the aircraft and an obstacle while the aircraft is on the ground. The obstacle can be, for example, another aircraft, a ground vehicle, an airport structure, or another object. In examples described herein, a processor of a ground obstacle collision alerting system of an aircraft is configured to deactivate delivery of ground obstacle collision alerts by the system in response to determining the aircraft is in a designated ground area. The processor is further configured to reactivate the delivery of the ground obstacle collision alerts in response to determining aircraft is outside of a designated ground area. The ground obstacle collision alerts may be indicative of the presence of an object within a particular distance of the aircraft. The disclosure also describes example devices, systems, and techniques for controlling a ground obstacle collision alerting system.

In some examples, a processor of a ground obstacle collision alerting system is configured to deactivate the delivery of ground obstacle collision alerts in response to user input (e.g., from a pilot in a cockpit of the aircraft), in response to automatically detecting the presence of the aircraft in a designated ground area (e.g., in the absence of user input indicating the same), or any combination thereof.

In addition, the processor of the ground obstacle collision alerting system is configured to automatically reactivate the delivery of ground obstacle collision alerts by the system, e.g., in response to determining the aircraft is outside of a designated ground area. For example, the processor may determine the aircraft is outside of the one or more designated ground areas based on a geographic location of the aircraft, based on a ground speed of the aircraft, or both. In some examples, in addition to being configured to automatically reactivate the ground obstacle collision alerts, the processor is further configured to reactivate the delivery of the ground obstacle collision alerts in response to receiving user input indicative of a request to reactivate the alerts.

In one aspect, the disclosure is directed to a method that comprises determining an aircraft is in a designated ground area, in response to determining the aircraft is in the designated ground area, deactivating delivery of ground obstacle collision alerts by a ground obstacle collision alerting system of the aircraft, after deactivating the delivery of the ground obstacle collision alerts, determining, by a processor, the aircraft is outside of the designated ground area, and reactivating, by the processor, the delivery of the ground obstacle collision alerts in response to determining the aircraft is outside the designated ground area.

In another aspect, the disclosure is directed to a system comprising a ground obstacle collision alerting system configured to deliver ground obstacle collision alerts indicative of one or more ground obstacle collision conditions for an aircraft, and a processor configured to determine the aircraft is in a designated ground area, control the ground obstacle collision alerting system to deactivate delivery of the ground obstacle collision alerts in response to determining the aircraft is in the designated ground area, after controlling the ground obstacle collision alerting system to deactivate the delivery of the ground obstacle collision alerts, determine the aircraft is outside of the designated ground area, and control the ground obstacle collision alerting system to reactivate the delivery of the ground obstacle collision alerts in response to determining the aircraft outside the designated ground area. In some examples, the ground obstacle collision alerting system comprises the processor.

In another aspect, the disclosure is directed to a system comprising means for determining an aircraft is in a designated ground area, means for deactivating delivery of ground obstacle collision alerts by a ground obstacle collision alerting system of the aircraft in response to determining the aircraft is in the designated ground area, means for determining the aircraft is outside of the designated ground area after deactivating the delivery of the ground obstacle collision alerts, and means for reactivating the delivery of the ground obstacle collision alerts in response to determining the aircraft is outside the designated ground area.

In another aspect, the disclosure is directed to an article of manufacture comprising a computer-readable storage medium. The computer-readable storage medium comprises computer-readable instructions for execution by a processor. The instructions cause a programmable processor to perform any part of the techniques described herein. The instructions may be, for example, software instructions, such as those used to define a software or computer program. The computer-readable medium may be a computer-readable storage medium such as a storage device (e.g., a disk drive, or an optical drive), memory (e.g., a Flash memory, read only memory (ROM), or random access memory (RAM)) or any other type of volatile or non-volatile memory that stores instructions (e.g., in the form of a computer program or other executable) to cause a programmable processor to perform the techniques described herein. The computer-readable medium is non-transitory in some examples.

The details of one or more examples are set forth in the accompanying drawings and the description below. Other features, objects, and advantages will be apparent from the description and drawings, and from the claims.

DETAILED DESCRIPTION

Figure 1:
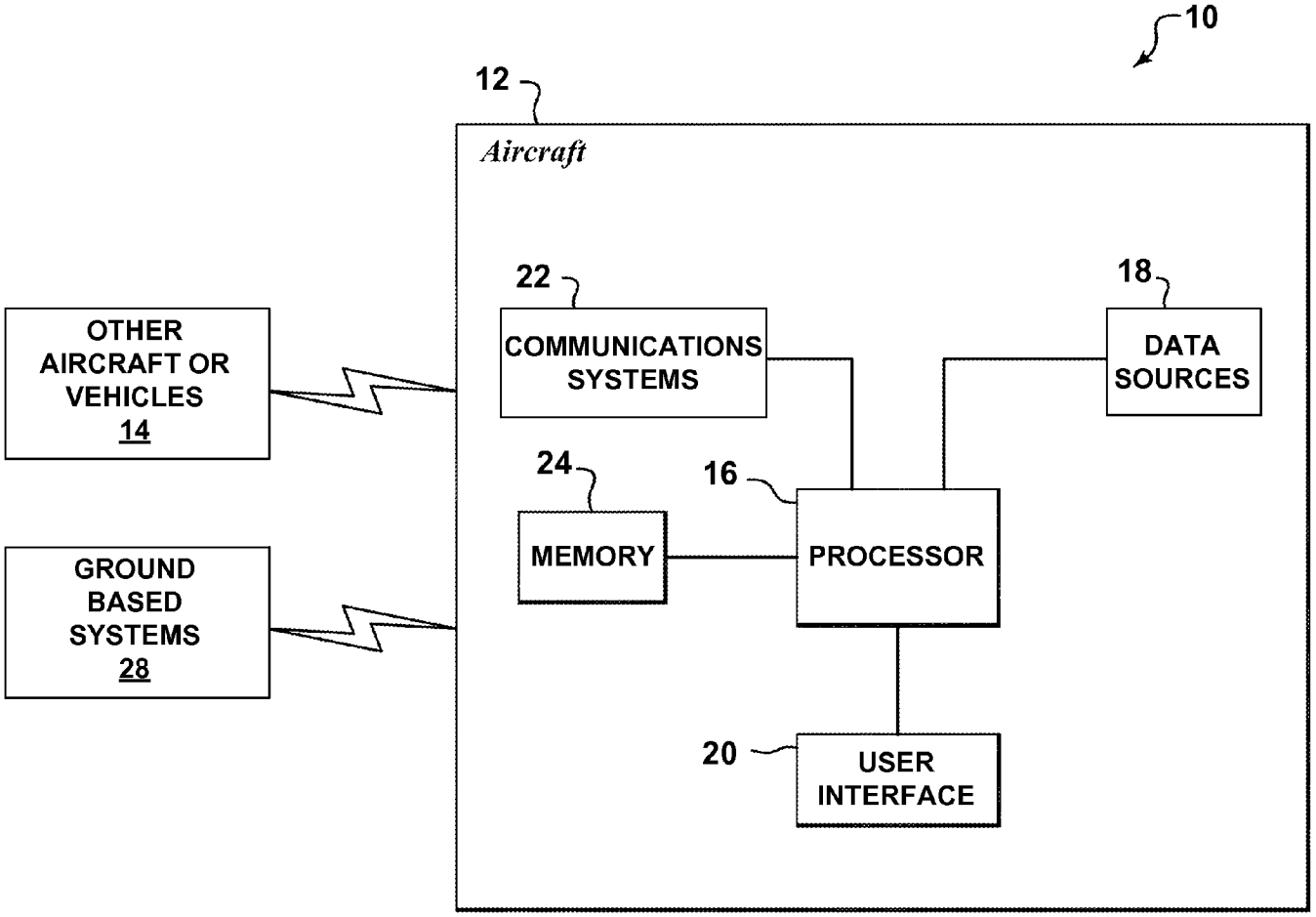
FIG. 1 is a block diagram illustrating an example ground obstacle collision alerting system of an aircraft, where the system is configured to deactivate delivery of ground obstacle collision alerts in response to determining an aircraft is in a designated ground area and automatically reactivate the delivery of the alerts in response to determining the aircraft is outside of a designated ground area.

Some aircraft are equipped with ground obstacle collision alerting systems used during ground operations to help an aircraft flight crew stay apprised of ground obstacle collision conditions. The ground obstacle collision alerting system may, for example, be configured to generate and deliver an alert to the crew (e.g., in the cockpit or remotely located) indicative of a potential collision between the aircraft and an obstacle (also referred to herein as an "object") while the aircraft is on the ground. Example obstacles include, but are not limited to, an aircraft hangar or other building, an airport terminal or other structure, a lighting pole, a ground vehicle, another aircraft, or a fence. For example, a ground obstacle collision alerting system of an aircraft may be configured to generate and deliver an alert in response to determining an object is within a particular distance of the aircraft (e.g., a specific structure of the aircraft, such as a wing, tail, or fuselage, or any portion of the aircraft). As another example, the system may be configured to generate an alert in response to determining there is a likelihood of collision between the aircraft and a ground object due to, for example, the direction in which the aircraft is traveling on the ground, the ground speed of the aircraft, and the distance between the aircraft and the object.

An aircraft flight crew member maneuvering an aircraft on the ground, e.g., as an aircraft taxis from a runway to a gate at an airport, may have difficulty being aware of potential collisions of portions of the aircraft with other objects as the aircraft is moving on the ground. The difficulty may arise in part due to limited visibility caused by the relatively large size of the aircraft, and due to potential distractions, such as other moving vehicles, or such as other taxiway maneuvers and related operations being performed by the aircraft crew. For example, due to the size of the aircraft, the wing tips or tail of the aircraft may inadvertently collide with one or more obstacles during a ground maneuver. The ground obstacle collision alerting system of the aircraft may help reduce the number, severity, or both, of inadvertent collisions of the aircraft with obstacles while the aircraft is on the ground.

An aircraft in some ground areas, such as a ramp area (also referred to herein as an "apron"), may be in closer proximity to ground obstacles, such as other aircraft, surface vehicles, and an airport structure, compared to when the aircraft is undertaking take-off and landing operations on a runway or during ground operations as part of taxiing. As a result, the type of collision avoidance algorithms that are used by the ground obstacle collision alerting system to generate the ground obstacle collision alerts, such as runway collision alerting or taxiway collision alerting, may result in a relatively high rate of unwanted alerts when the aircraft is in certain ground areas, referred to herein as designated ground areas. The unwanted alerts may interfere with communications between the aircraft crew and ground crew, create a distraction from the ground personnel providing the aircraft crew with ground maneuvering instructions, provide misleading information to the aircraft crew, or any combination thereof.

A ground obstacle collision alerting system described herein is configured to deactivate the delivery of ground obstacle collision alerts to the aircraft crew when the aircraft (also referred to herein as an "ownship" or "host vehicle") is in one or more designated ground areas. This may help deactivate the ground obstacle collision alerts when the alerts may not provide a benefit to the aircraft crew (e.g., a pilot maneuvering the aircraft), including situations in which the alerts may be more of a distraction or nuisance to the aircraft crew than a benefit. The example ground obstacle collision alerting systems disclosed herein are configured to deal with transitions to a designated ground area (e.g., a ramp area) in which the ground obstacle collision alerts may give unwanted alerts or even an unacceptable level of nuisance alerts.

For example, when an aircraft is in a ramp area of an airport, the crew of the aircraft may primarily rely on ground crew, rather than the ground obstacle collision alerting system, radar, or other navigation aids, to provide ground maneuvering instructions that help the crew maneuver the aircraft on the ground to avoid obstacles. Given the nature of a ramp area, when the aircraft is in the ramp area, the aircraft may be in relatively close proximity to ground vehicles (also referred to herein as "surface vehicles"), the airport terminal structure, and other objects. Thus, while the aircraft is in the ramp area, the ground obstacle collision alerting system may deliver a plurality of alerts to indicate the presence of the objects in close proximity to the aircraft. The aircraft crew, however, may not be in a position to react to the alerts, e.g., because of a lack of ability to react or because of a primary reliance on the ground crew to guide the pilot. The lack of ability to react may mean, for example, that the aircraft crew cannot or should not execute a collision-avoidance action in response the alert, such as by maneuvering the aircraft away from every object within a particular range of the aircraft when the aircraft is in the ramp area because the size of the ramp area and the high density of objects within the ramp area. Thus, in some examples, the one or more designated areas in which the alerts delivered by the ground obstacle collision alerting system are deactivated includes a ramp area of an airport.

A designated ground area is a geographic area (or "region") on the ground. In addition to, or instead of a ramp area of an airport, a designated ground area can be a gate area (which may also be a part of a ramp area in some cases), a fueling area, a de-icing area, or another ground area in which the aircraft is in relatively close proximity to ground obstacles compared to when the aircraft is taxiing or on a runway. As another example, the designated ground area may be a geographic area in which the aircraft crew relies on ground personnel for direction in maneuvering the aircraft to avoid ground obstacles. A designated ground area may be, in some examples, an area in which the aircraft may be parked or serviced. In some examples, the designated ground area does not include any runways. In addition, the one or more designated ground areas discussed herein can include any combination of ground areas, which need not be contiguous, but may be a list of designated ground areas.

In some examples, a processor is configured to deactivate the delivery of ground obstacle collision alerts to an aircraft crew (e.g., onboard the aircraft) in response to user input (e.g., from the aircraft crew in the cockpit of the aircraft), in response to automatically detecting the presence of the aircraft in a designated ground area (e.g., in the absence of user input indicating the same), or any combination thereof. The processor can be a part of the ground obstacle collision alerting system and can, but need not be, located onboard the aircraft to which the alerts are delivered. The processor can deactivate the delivery of the alerts by controlling the ground obstacle collision alerting system to not generate the alerts, such that there are no alerts to deliver to the crew, or by controlling the ground obstacle collision alerting system to not deliver any generated alerts.

The processor is further configured to automatically reactivate the delivery of the ground obstacle collision alerts by the ground obstacle collision alerting system in response to determining the aircraft is outside of a designated ground area, which may be the same designated ground area the aircraft was in when the delivery of alerts were deactivated. In some examples, the processor is configured to determine the ownship is outside of a designated ground area based on a geographic position of the ownship, based on a ground speed of the ownship, or both geographic location and aircraft ground speed. In some examples, in addition to being configured to automatically reactivate the ground obstacle collision alerts, the processor is further configured to reactivate the delivery of the ground obstacle collision alerts in response to receiving user input indicative of a request to reactivate the delivery of the ground obstacle collision alerts.

FIG. 1 is a block diagram illustrating an example ground obstacle collision alerting system 10, where the ground obstacle collision alerting system 10 is configured to generate and deliver ground obstacle collision alerts in response to detecting one or more ground obstacle collision conditions for aircraft 12. The ground obstacle collision alert may be audible, visual, somatosensory, or any combination thereof. The alerts provide a warning to the aircraft crew, which may be onboard aircraft 12 or remotely located.

A ground obstacle collision condition for aircraft 12 can include, for example, a condition in which there is a potential for a collision between aircraft 12 and an obstacle while aircraft 12 is on the ground, e.g., due to the distance between aircraft 12 and the obstacle, due to the speed and direction of aircraft 12 relative to the obstacle, or any combination thereof. Thus, the ground obstacle collision condition may be occur because, for example, any combination of a ground based trajectory of aircraft 12, a ground based trajectory of other vehicles 14 (e.g., aircraft or ground service equipment, such as tug tractors, baggage carts, and refueling trucks), and the location of other moving or nonmoving objects, such as airport structures.

In the example shown in FIG. 1, system 10 includes processor 16, one or more data sources 18 (e.g., global positioning system (GPS)), user interface 20, communications system 22, and memory 24. A portion of system 10 or the entire system 10 can be located on an aircraft 12. For example, in the example shown in FIG. 1, processor 16, data sources 18, user interface 20, communications system 22, and memory 24 are onboard aircraft 12.

In other examples, a portion of system 10 may be located external to aircraft 12, such as in an air traffic control center or another ground control center. For example, a processor may be located external to aircraft 12 and may perform any part of the functions attributed to processor 16 herein. For example, the processor located external to aircraft 12 may be configured to detect one or more ground obstacle collision conditions based on data received from data sources 18 onboard aircraft 12, as well as data sources (e.g., other aircraft 14 or ground-based systems 28, or both) external to aircraft 12, and control user interface 20 onboard aircraft 12 to deliver a ground obstacle collision alert in response to detecting the condition. The processor located external to aircraft 12 may, for example, be configured to transmit a control signal to processor 16 onboard aircraft 12 via communications system 22. In addition, in some examples, the processor located external to aircraft 12 may also be configured to control system 10, e.g., to deactivate the delivery of ground obstacle collision condition alerts in accordance with techniques described herein, to reactivate the delivery of ground obstacle collision condition alerts in accordance with techniques described herein, or both.

Processor 16, as well as other processors disclosed herein, can comprise any suitable arrangement of hardware, software, firmware, or any combination thereof, to perform the techniques attributed to processor 16 herein. For example, processor 16 may include any one or more microprocessors, digital signal processors (DSPs), application specific integrated circuits (ASICs), field programmable gate arrays (FPGAs), or any other equivalent integrated or discrete logic circuitry, as well as any combinations of such components. Memory 24 includes any volatile or non-volatile media, such as a RAM, ROM, non-volatile RAM (NVRAM), electrically erasable programmable ROM (EEPROM), flash memory, and the like. Memory 24 may store computer readable instructions that, when executed by processor 16, cause processor 16 to the techniques attributed to processor 16 herein.

User interface 20 is configured to deliver ground obstacle collision alerts to a user, who may be a part of a crew in a cockpit of aircraft 12 or may be located remotely from aircraft 12. For example, user interface 20 can include one or more of a display screen (e.g., a liquid crystal display (LCD) or a light emitting diode (LED) display) configured to present information to the user, a speaker configured to deliver an audible alert, or a sensory device configured to deliver a somatosensory alert. In some examples, the display may be a touch screen display. In addition, user interface 20 can include one or more of a keypad, buttons, a peripheral pointing device or another input mechanism that allows the user to provide input. The buttons may be dedicated to performing a certain function, e.g., receiving user input indicative of a specific type of input, or the buttons and the keypad may be soft keys that change in function depending upon the section of a display currently viewed by the user.

Processor 16 is configured to send and receive information over a data channel via communications system 22, which may include a transponder (e.g., a receiver or a transmitter). For example, processor 16 may be configured to send, receive, or both send and receive data from data sources external to aircraft 12, such as from other vehicles 14 and ground-based systems 28. The data received by processor 16 can include, for example, data indicative of potential ground obstacle collision conditions. Examples of data that can be received from sources external to aircraft 12 include, but are not limited to, data indicating the position and, in some cases, the velocity (e.g., speed and direction), of other aircraft on the ground, such as automatic dependent surveillance-broadcast/traffic information service-broadcast (ADS-B/TIS-B) data received from other aircraft or ground vehicles, data transmitted by an airport or airline and indicating the position of other vehicles/aircraft/obstacles (e.g., received by aircraft 12 via a Worldwide Interoperability for Microwave Access (WiMAX)), or any combination thereof.

Processor 16 is also configured to receive data from, and, in some cases, control, one or more data sources 18 onboard aircraft 12. The communicative coupling between processor 16 and one more data sources 18 may be, for example, a data bus. The input from one or more data sources 18 may also be stored in memory 24 in some examples. Different input may be stored in memory 24 so as to define different types of obstacles or different types of input, and processor 16 may be configured to interpret data in memory 24 as being indicative of different obstacles or input. Memory 24 may implement a mapping scheme (e.g., a table) for efficiently storing information from data sources 18 and processor 16 may be configured to understand the mapping scheme used by memory 24 so that data in memory 24 can be interpreted as the input that was received from data sources 18.

One or more data sources 18 are configured to generate data from which processor 16 may determine whether a ground obstacle collision condition exists. Thus, processor 16 may detect a ground obstacle collision condition for aircraft 12 based on data from one or more data sources 18. For example, one or more data sources 18 may be configured to generate data indicative of a position of aircraft 12. For example, one or more data sources 18 may include GPS, inertial navigation system (INS), or another positioning system configured to indicate the location of aircraft 12. The location of aircraft 12 indicated by the data from one or more data sources 18 may be the geographic location (e.g., latitude and longitude) of aircraft 12, the location of aircraft 12 relative to one or more landmarks, or any combination thereof.

In addition, or instead of, the positioning system, in some examples, one or more data sources 18 include other sensors configured to generate information indicative of obstacles near aircraft 12 (e.g., surrounding aircraft). Sensors of data sources 18 configured to provide information about obstacles near aircraft 12 can include one or more active sensors (e.g., one or more radar sensors), one or more passive sensors (e.g., one or more cameras), or any combination thereof. The sensors may be located at any suitable place on aircraft 12. For example, in some examples, if the sensors include radar sensors or cameras, the radar sensors or cameras can be located on tips of the wings of aircraft 12 and oriented along a horizontal plane to detect the presence of objects at the same height of the wings. In addition, the sensors may be oriented in any suitable direction for detecting ground obstacles. In some examples, the fields of view (FOVs) of the sensors can be selected such that sensors help provide a crew of aircraft 12 stay apprised of obstacles proximate certain portions of aircraft 12, such as near the wings and tail of aircraft 12. In addition, the sensors can have any sensor range suitable for providing the pilot with advanced notice of obstacles, e.g., with enough time to maneuver aircraft 12 on the ground to avoid the detected obstacles.

In some examples, the one or more sensors of data sources 18 include one or more radar sensors, which are each configured to generate and emit a radar pulse and detect a radar return pulse. The radar return pulse is generated by reflected energy from an object upon which the emitted radar pulse is incident on, where the object can be obstacles (e.g., ground objects) in an area of interest about aircraft 12. The radar sensor can include an antenna (e.g., a stationary antenna or an antenna that may be moved to sweep an area of interest) configured to receive the radar return pulses. Processor 16 can be configured to determine the location (e.g., coordinates or location relative to aircraft 12) of ground obstacles based on the radar return pulses. The one or more radar sensors can include, for example, any suitable radar sensors, such as, but not limited to, radar sensors used in a weather radar system of aircraft 12 or radar sensors dedicated to detecting ground objects near aircraft 12.

In some examples, the one or more sensors of data sources 18 include one or more cameras. Processor 16 may be configured to receive images captured by the one or more cameras and process the images to detect an obstacle.

Processor 16 is configured to receive data via one or more of communications system 22 and data sources 18, detect a ground obstacle collision condition based on the received data, and control user interface 20 to deliver an alert indicative of a ground obstacle collision condition. The ground obstacle collision condition can be, for example, the existence of a potential collision with a ground obstacle (e.g., another aircraft, an airport structure, or a ground vehicle) while aircraft 12 is taxiing or otherwise maneuvering on the ground. The ground obstacle collision condition may be, for example, a detection of a ground obstacle within a particular distance range of aircraft 12, a ground obstacle is in the pathway of aircraft 12, which may be determined based on the heading and speed of aircraft 12 indicated by data sources 18, or any combination thereof.

User interface 20 is configured to deliver an alert indicative of a ground obstacle collision condition. The alert can be, for example, audible, visual, somatosensory, or any combination thereof. For example, user interface 20 may comprise one or more of headphones, a speaker, a visual display, or a tactile device. The display can include, for example, an electronic flight bag (EFB), a primary flight display (PFD), a multifunction display (MFD), a navigation display, or any other suitable display. In some examples, user interface 20 includes a display configured to present a situational display of detected ground obstacles and processor 16 can control the display to include a status of the ground obstacles (e.g., the possibility of a collision). A visual alert presented on a display can indicate the ground obstacle collision condition using any suitable technique, such as by displaying a graphical representation of aircraft 12 (e.g., an outline of aircraft wingtips or tail) and a graphical representation of any ground obstacles, which may be visually represented so as to a highlight any potential ground obstacle collision conditions.

Processor 16 can be configured to implement any suitable ground obstacle collision avoidance technique to detect a ground collision avoidance condition. For example, processor 16 may be configured to implement any of the ground collision avoidance techniques described in commonly-assigned U.S. Patent Application Publication No. 2012/0200433 by Glover et al., which is entitled, "AIRPORT TAXIWAY COLLISION ALERTING SYSTEM" and was published on Aug. 9, 2012, the entire content of which incorporated herein by reference. In addition, aircraft 12 may include any devices and systems described in U.S. Patent Application Publication No. 2012/0200433 by Glover et al.

U.S. Patent Application Publication No. 2012/0200433 by Glover et al. describes a system on a host vehicle that includes a receiver that receives information about one or more other vehicles on the ground, memory that stores information about the host vehicle, one or more sensors that determines information about the host vehicle and an output device. The system also includes a processor that determines one or more first protection zones around each of the other vehicles based on the received information about the one or more other vehicles, determines a second protection zone around the host vehicle based on the stored information about the host vehicle and the sensor information and generates an alert, if any of the first protection zones occupies at least a portion of the same geographic area as the second protection zone. The generated alert is outputted via the output device.

Thus, in some examples, processor 16 is configured to determine aircraft 12 information (from data sources 18, such as from a GPS) and determine the state of other vehicles on the ground (e.g., based on position, velocity, acceleration, track-angle and/or heading data about the other vehicles provided by the other vehicles, provided by a ground based system, or both) and vehicle type information. Processor 16 may then determine two-dimensional buffer zones (e.g., boxes) that surround each of aircraft 12 and the target vehicles using the techniques described in U.S. Patent Application Publication No. 2012/0200433 by Glover et al., and then output an alert via user interface 20 when the zones intersect, thereby indicating a ground obstacle collision condition.

In addition to, or instead of, the techniques described above, processor 16 may be configured to ground obstacle collision avoidance techniques described in U.S. patent application Ser. No. 12/835,122 by Lamkin et al., which was filed on Mar. 15, 2013 and is entitled, "COLLISION-AVOID- ANCE SYSTEM FOR GROUND CREW USING SENSORS." U.S. patent application Ser. No. 12/835,122 by Lamkin et al. is incorporated herein by reference in its entirety. In addition, aircraft 12 may include any devices and systems described in U.S. patent application Ser. No. 12/835,122 by Lamkin et al.

In accordance with example devices, systems, and techniques described in U.S. patent application Ser. No. 12/835,122 by Lamkin et al., data sources 18 can include a plurality of radar sensor modules each including a radar emitter and a detector device. Each radar sensor module is configured to emit, via the respective radar emitter, radar signals, receive, at the respective detector device, radar return signals corresponding to reflections of the emitted signal from a ground obstacle, and transmit radar information associated with the received radar signal reflections reflected from the ground obstacle. Each of the plurality of radar sensor modules can be uniquely located on a surface of aircraft 12 that is at risk for collision with a ground obstacle if the aircraft is moving (e.g., on wing tips, tail, vertical stabilizer, cowlings of the aircraft engines, or any combination thereof). Processor 16 can receive the radar return signals from the radar sensor modules, identify locations of ground obstacles in proximity to aircraft 12 based on the radar return signals (e.g., within a predetermined distance threshold of aircraft 12). Processor 16 can generate a ground obstacle collision alert and deliver the alert, e.g., by controlling user interface 20 to deliver an audible alert, by controlling a display of user interface 20 to present a view (e.g., a plan view) indicating an aircraft icon representative of aircraft 12 and a graphical ground obstacle icon that is associated with the detected ground obstacle, or via any combination of alerts.

In addition to, or instead of, the techniques described above, processor 16 may be configured to ground obstacle collision avoidance techniques described in U.S. patent application Ser. No. 13/742,688 by Kirk et al., which was filed on Jan. 16, 2013 and is entitled, "AIRPORT SURFACE COLLISION-AVOIDANCE SYSTEM (ASCAS)." U.S. patent application Ser. No. 13/742,688 by Kirk et al. is incorporated herein by reference in its entirety. In addition, aircraft 12 may include any devices and systems described in U.S. patent application Ser. No. 13/742,688 by Kirk et al.

In accordance with example devices, systems, and techniques described by U.S. patent application Ser. No. 13/742,688 by Kirk et al., data sources 18 can include one or more wingtip mounted cameras, which are each configured to generate a video stream. The one or more cameras can be, for example, day/night cameras, an infrared camera, or any other suitable camera. The one or more cameras can be, for example, incorporated into wingtip-mounted aircraft light modules. The cameras can each be aimed along an axis parallel (coaxial) to the fuselage of aircraft 12 (i.e., longitudinal axis of the fuselage). Processor 16 can be configured to control a display of user interface 20 to display the images captured by the one or more cameras. In addition, processor 16 can be configured to add a reference reticule (e.g., a reference grid) to each camera video, where the reference reticule permits the pilot to easily see the wingtips' location relative to obstacles visible in the camera video. Processor 16 can be configured to generate a ground obstacle collision alert in response to detecting a ground obstacle within a particular range of aircraft 12 based on the images captured by the one or more wingtip cameras and deliver the alert via user interface 20.

Another example ground collision alerting technique that may be implemented by processor 16 is described in commonly-assigned U.S. patent application Ser. No. 13/710,400 by Bateman et al., which is entitled, "AIRPORT SURFACE COLLISION-AVOIDANCE SYSTEM (ASCAS)" and was filed on Dec. 10, 2012, the entire content of which is incorporated herein by reference. In addition, aircraft 12 may include any devices and systems described in U.S. patent application Ser. No. 13/710,400 by Bateman et al.

U.S. patent application Ser. No. 13/710,400 by Bateman et al. discloses an airport surface collision-avoidance system (ASCAS) that includes a plurality of sensors (e.g., one or more active sensors, such as radar, one or more passive sensors, such as a camera, or both) within aircraft light modules. Based on information from these sensors, one or more devices provide some or all of the following functions: detect and track intruders, evaluate and prioritize threats, and declare and determine collision-avoidance actions. The ASCAS is configured to help avoid collisions on the airport surface (e.g., during taxiing clear of airport buildings, during taxiing close to airport buildings, during gate operations), between an aircraft and any type of intruder (e.g., another aircraft, airport building, and ground service equipment), during all visibility conditions, for any type of collision (e.g., a collision with an object and an aircraft wingtip, tail assembly, engine cowl, fuselage, door, or any combination thereof), and while the ownship is under its own power or receives power from an external device.

Processor 16 is configured to generate ground obstacle collision alerts and control system 10 to deliver the alerts in response to detecting a ground obstacle collision condition for aircraft 12, e.g., in accordance with any of the techniques referenced above. In addition, processor 16 is configured to deactivate the delivery of ground obstacle collision alerts by system 10 in response to determining aircraft 12 is in one or more designated ground areas. The one or more designated ground areas in which the alerts are deactivated may be preselected and stored by system 10 (e.g., in memory 24 or another memory).

Processor 16 can determine aircraft 12 is in a designated ground area of the one or more designated ground areas using any suitable technique. In some examples, processor 16 determines aircraft 12 is in a designated ground area in response to user input, e.g., received via user interface 20 from aircraft crew a cockpit of aircraft 12, or received from an external user (e.g., in an air traffic control tower or another ground-based system 28). The user input may be, for example, indicative of a request to deactivate the ground obstacle collision alerts because aircraft 12 is in a designated ground area. The user input may be provided using any suitable mechanism. For example, user interface 20 can include one or more buttons, a keypad, or both, which may be dedicated to receiving input that indicates aircraft 12 is in one or more designated ground areas or receive input requesting the ground obstacle collision alerts be deactivated, or the buttons and the keypad may be multifunction buttons or keys, such as soft keys.

In addition to, or instead of, determining aircraft 12 is in the one or more designated ground areas based on user input, processor 16 can be configured to automatically determine aircraft 12 is in a designated ground area based on a location of aircraft 12. For example, processor 16 can determine aircraft 12 is in a designated ground area based on location information, such as based on geographic coordinates of aircraft (e.g., determined based on a GPS) and a database of designated ground area locations, based on a location of aircraft 12 relative to one or more landmarks (e.g., an airport structure), or any combination thereof.

In some examples, the database of designated ground area locations is stored by memory 24. In addition to, or instead of memory 24 onboard aircraft 12, the database of designated ground area locations can be stored by a device external to aircraft 12 and accessible to processor 16 via, e.g., a communication system 22 (e.g., any suitable datalink).

In some examples, the database stores geographic locations of the one or more designated ground areas, e.g., using geographic coordinates (e.g., defining endpoints of line segments that outline a designated ground area) or other indicia. In addition, in some examples, the database (which may be stored in memory 24) includes one or more (e.g., a plurality) maps of various ground surfaces, such as one or more airports, and indications of the areas of the ground surfaces that are designated ground areas. For example, the database may indicate, e.g., using geographic coordinates or other indicia, the one or more designated ground areas associated with a particular map. The geographic coordinates identifying a designated ground area can be, for example, relative to the surface of the earth, such as longitude and latitude coordinates. Airport configurations may change over time. Thus, the database of designated ground area locations stored by memory 24 or another memory can be periodically updated, e.g., automatically by processor 16 based on data provided by another database or manually by a user.

Processor 16 can select a map using any suitable technique. In some examples, processor 16 selects a map from the database based on a current location of aircraft 12, such as by identifying the map of the surface area located closest to the current location of aircraft 12. In other examples, processor 16 may select a map based on input from a user received via user interface 20. For example, the crew of aircraft 12 may manually specify a particular map by manually specifying an airport via user interface 20. In response, processor 16 may select a map that is associated with the airport.

After selecting the map, processor 16 can reference the map, geographic coordinates or other indicia of one or more designated ground areas, or both to determine whether aircraft 12 is in a designated ground area. For example, processor 16 may determine aircraft 12 in a designated ground area in response to determining the current location (e.g., current geographic coordinates) of aircraft 12 overlaps with a designated ground area (e.g., overlaps with the geographic coordinates of the designated ground area). In other examples, processor 16 can determine whether aircraft 12 is in a designated ground area by comparing the current location of aircraft 12 to the stored geographic coordinates or other indicia of the one or more designated ground areas using any other suitable technique.

In some examples, processor 16 may control a display of user interface 20 to display the selected ground surface map, which may provide information identifying the location of various structures on the ground surface, such as runway boundaries, taxiway boundaries, light and/or sign structures, buildings, or the like. Accordingly, the location of these various structures may be presented on the display referenced to relative current location of aircraft 12.

In some examples, processor 16 deactivates the ground obstacle collision alerts by at least controlling system 10 such that no further ground obstacle collision alerts are delivered via user interface 20. Thus, in this manner, the ground obstacle collision alerts may be considered to be suppressed. In the case of visual alerts, the deactivation of the delivery of ground obstacle collision alerts may cause the visual display to no longer be displayed. In the case of audible alerts, the deactivation of the delivery of the ground obstacle collision alerts may cause the audible alerts to no longer be transmitted or not audible to the crew of aircraft 12. In the case of somatosensory alerts, the deactivation of the delivery of ground obstacle collision alerts may cause the somatosensory alerts to no longer be transmitted or not perceived by user (e.g., a crew member of aircraft 12). In some cases, processor 16 can generate a visual, audible, or somatosensory notification to the crew of aircraft 12 that the delivery of ground obstacle collision alerts has been deactivated.

Processor 16 can deactivate the ground obstacle collision alerts using any suitable technique. In some examples, processor 16 does not generate any alerts, and, therefore, no alerts are delivered via user interface 20. As an example, processor 16 may block the receipt of data indicative of ground obstacle collision conditions from data sources 18 and other devices via communication systems 22, and, therefore, does not detect any ground obstacle collision conditions. In other examples, processor 16 may continue to receive data from data sources 18 and other devices via communications system 22 while the delivery of ground obstacle collision alerting system is deactivated. In yet other examples, processor 16 continues to generate ground obstacle collision alerts, but may stop controlling user interface 20 to deliver the alerts.

Processor 16 is further configured to automatically reactivate the ground obstacle collision alerts in response to determining aircraft 12 is outside of a designated ground area. As discussed in further detail below with respect to FIG. 2, in some examples, processor 16 is configured to determine aircraft 12 is outside of the one or more designated ground areas based on a geographic location of aircraft 12, based on a ground speed of aircraft 12, or both.

The system shown in FIG. 1 is one example of a ground obstacle collision alerting system of an aircraft 12 that is configured to automatically deactivate delivery of ground obstacle collision alerts in response to determining aircraft 12 is in a designated ground area and configured to automatically reactivate delivery of the ground obstacle collision alerts in response to determining aircraft 12 is outside a designated ground area. In other examples, the techniques described herein for automatically deactivating and reactivating ground obstacle collision area may be used with other ground obstacle collision alerting systems, such as systems that use different data sources than those described herein to detect a ground obstacle collision condition. Any suitable algorithm may be used to detect ground obstacle collision conditions and generate the ground obstacle collision alerts described herein.

Figure 2:
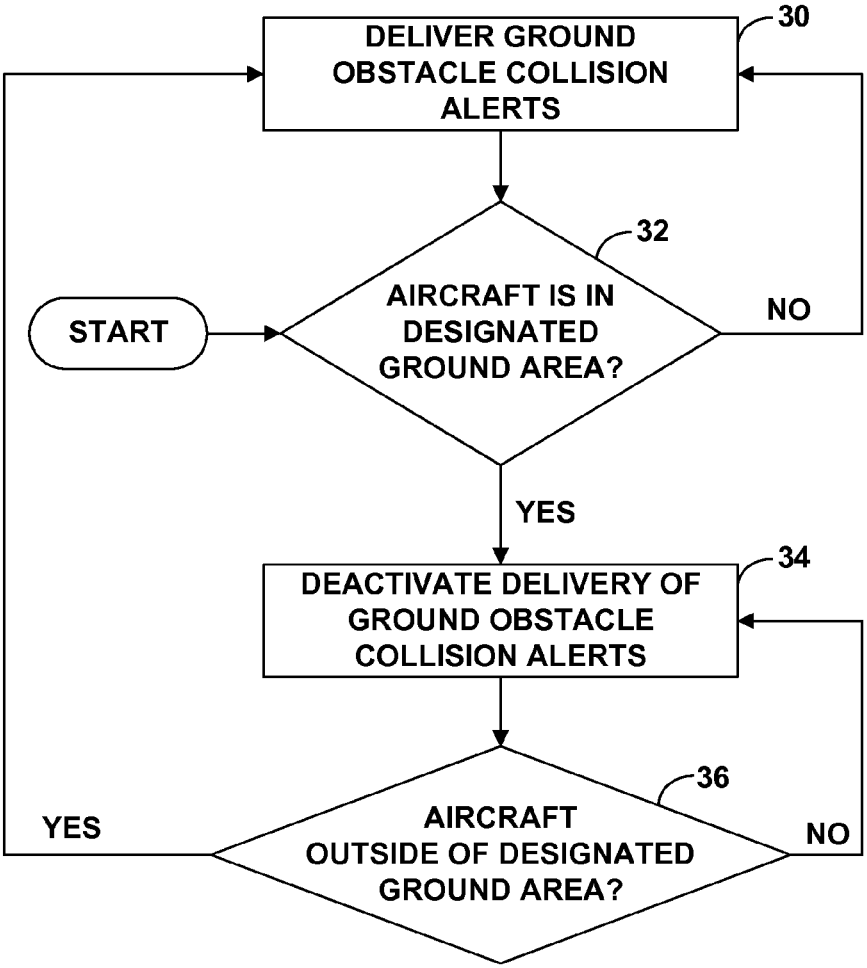
FIG. 2 is a flow diagram illustrating an example technique for controlling a ground obstacle collision alerting system to deactivate and automatically reactivate the delivery of ground obstacle collision alerts.

FIG. 2 is a flow diagram illustrating an example technique for controlling a ground obstacle collision alerting system. While FIG. 2 is described with respect to system 10 shown in FIG. 1, in other examples, the technique shown in FIG. 2 may be executed by another system that is configured to generate ground obstacle collision alerts. The control of a ground obstacle collision alerting system described herein may be applicable to any suitable system, regardless of the specific algorithm with which the ground obstacle collision alerts are generated.

In some examples, the technique shown in FIG. 2 may start with determining whether aircraft 12 is in a designated ground area (32) prior to generating ground obstacle collision alerts (30). In this way, system 10 may not generate unwanted alerts upon start-up of the system. In other examples, the technique shown in FIG. 2 may start with generating ground obstacle collision alerts (30).

Processor 16 determines whether aircraft 12 is in a designated ground area (32). In some examples, processor 16 determines aircraft 12 is in a designated ground area based on received input, which can be user input manually inputted by the crew of aircraft 12 via user interface 20 or information that indicates a geographic location of aircraft 12 and a database stored by memory 24 and including data indicating one or more designated ground area locations. The information that indicates a geographic location of aircraft 12 can be generated by any suitable device, such as, but not limited to, one or more of a GPS sensor onboard aircraft 12, a ground-based system 28, or another positioning system onboard aircraft 12 or external to aircraft 12 and configured to generate data indicating a geographic location of aircraft. Thus, in some examples, processor 16 determines aircraft 12 is in a designated ground area (32) based on data received from one or more data sources 16, one or more ground-based systems 28, or one or more other data sources.

In response to determining aircraft 12 is not a designated ground area ("NO" branch of block 32), processor 16 determines whether any ground obstacle collision conditions are detected, generates alerts in response to detecting ground obstacle collision conditions, and controls user interface 20 to deliver ground obstacle collision alerts (30) in response to detecting ground obstacle collision conditions. For example, processor 16 can control user interface 20 to deliver one or more ground obstacle collision alerts to a pilot or other user (e.g., in a cockpit of aircraft 12) in response to detecting a ground obstacle collision condition based on data received from one or more of data sources 18, other aircraft or vehicles 14, or ground-based systems 28 (FIG. 1). Processor 16 can implement any suitable technique to detect the ground obstacle collision condition. For example, processor 16 can implement any of the techniques described above, such as those described in U.S. Patent Application Publication No. 2012/0200433 by Glover et al., U.S. patent application Ser. No. 12/835,122 by Lamkin et al., U.S. patent application Ser. No. 13/742,688 by Kirk et al., and U.S. patent application Ser. No. 13/710,400 by Bateman et al.

In response to determining aircraft 12 is in a designated ground area ("YES" branch of block 32), processor 16 deactivates the delivery of ground obstacle collision alerts (34). In some examples, when the ground obstacle collision alerts are deactivated, no further alerts indicative of ground obstacle collision conditions are provided to the crew of aircraft 12 (or other users) via user interface 20. In some examples, processor 16 deactivates the ground obstacle collision alerts by at least blocking the receipt of data indicative of ground obstacle collision conditions from data sources 18 and other devices via communication systems 22. In other examples, processor 16 may continue to receive data from data sources 18 and other devices via communications system 22 while the ground obstacle collision alerting system is deactivated, but processor 16 may not implement the ground obstacle collision condition detection algorithms, such that no ground obstacle collision conditions are detected, or may otherwise stop controlling user interface 20 to deliver the alerts to the user.

In some examples, processor 16 deactivates the ground obstacle collision alerts (34) after a predetermined waiting period, which begins when processor 16 determines aircraft 12 is in a designated ground area (32). In some examples, the predetermined waiting period is about 1 second to about 5 seconds, but may differ in other examples. In some examples, system 10 includes a timer, and processor 16 may start the timer immediately after determining aircraft 12 is in a designated ground area ("YES" branch of block 32). After the timer expires, processor 16 may deactivate ground obstacle collision alerts (34). A predetermined waiting period somewhere between approximately 1 second and approximately 5 seconds may provide a desirable balance to ensure prompt deactivation of the ground obstacle alerts only when the aircraft is located in the designated ground area for a sufficient amount of time.

Aircraft 12 may be in a designated ground area in which it may be desirable to deactivate the ground obstacle collision alerts for only a limited period of time, after which, a crew of aircraft 12 may maneuver aircraft 12 in ground areas in which the ground obstacle collision alerts may be useful to the crew. For example, if the designated ground area is a ramp area, aircraft 12 may leave the ramp area after loading and unloading passengers or other payload and maneuver onto a taxiway or runway, or both. Thus, it may be desirable to reactivate the ground obstacle collision alerts at some point after processor 16 deactivates the delivery of ground obstacle collision alerts (34).

In the technique shown in FIG. 2, sometime after processor 16 deactivates the delivery of ground obstacle collision alerts (34), processor 16 determines whether aircraft 12 is outside of a designated ground area (36). As discussed above, in some examples, processor 16 is configured to determine aircraft 12 is outside of the one or more designated ground areas based on a geographic location of aircraft 12, based on a ground speed and heading of aircraft 12, or any combination hereof.

In some examples, processor 16 determines aircraft 12 is outside of (e.g., no longer in) a designated ground area (36) in response to determining, based on information that indicates a geographic location of aircraft 12, aircraft 12 is physically outside of a designated ground area. For example, processor 16 can determine aircraft 12 is physically outside of a designated ground area by at least comparing the current geographic location (e.g., geographic coordinates) of aircraft 12 to data stored by memory 24 and indicating one or more designated ground area locations and including data indicating one or more designated ground area locations. As discussed above, such data indicating one or more designated ground area locations can include a map of a ground surface (e.g., an airport), geographic coordinates or other indicia of one or more designated ground areas, or both. Processor 16 may be configured to determine aircraft 12 is physically outside of a designated ground area in response to determining the current geographic coordinates of aircraft 12 do not overlap with the geographic coordinates of any designated ground areas.

In some examples, a designated ground area is an area in which aircraft 12 is expected to move at relatively slow speeds, e.g., under the direction of ground personnel. For example, in a ramp area, aircraft 12 may be moving at a relatively low speed until a destination is reached, where the destination may be an airport terminal or other stopping point. Thus, in some examples, a maximum ground speed limit or a nominal ground speed may be associated with the ramp area, where the maximum ground speed or nominal ground speed may be determined by any suitable party, such as airport personnel, airline personnel, or a governmental entity (e.g., the Federal Aviation Administration). Accordingly, in some examples, the ground speed of aircraft 12 may be indicative of the location of aircraft 12 outside of a designated ground area.

In addition to, or instead of, determining aircraft 12 is outside of a designated ground area (36) in response to determining aircraft 12 is physically outside of a designated ground area, processor 16 may be configured to determine aircraft 12 is no longer in a designated ground area (36) based on a ground speed of aircraft 12. For example, processor 16 can determine a ground speed of aircraft 12, compare the determined ground speed to a predetermined speed threshold (e.g., stored by memory 24 or another memory), and determine aircraft 12 is no longer in a designated ground area in response to determining the ground speed of aircraft 12 is greater than or equal to the predetermined speed threshold. Processor 16 can determine a ground speed of aircraft 12 based on data from one or more data sources 18, such as based on data from a flight management system, a GPS, an inertial measurement unit, one or more ground speed velocity sensors, and the like.

The predetermined speed threshold may be determined by any suitable party, such as airport personnel, airline personnel, or a governmental entity (e.g., the FAA). In some examples, the predetermined speed threshold may be selected to be approximately equal to or slightly less than (e.g., about 5% to about 10% less than) the recommended nominal ground speed of aircraft 12 within a particular designated ground area, which may help ensure processor 16 automatically reactivates the ground obstacle collision alerts before aircraft 12 is either outside of the designated ground area or while aircraft 12 is immediately outside of a designated ground area (e.g., with a particular distance range, such as, but not limited to, about 1 meter to about 50 meters). In some examples, the predetermined speed threshold is about 10 knots to about 15 knots.

The predetermined speed threshold may differ depending on the particular designated ground area in which aircraft 12 is located, and, thus, processor 16 may, in some examples, select the predetermined speed threshold based on the particular designated ground area in which aircraft 12 is located. For example, memory 24 may store a plurality of designated ground areas and associated speed thresholds, and processor 16 may access the data stored by memory 25 to determine a speed threshold for a particular designated ground area, which may be determined based on a current location of aircraft 12.

In some examples, processor 16 determines aircraft 12 is outside of a designated ground area (36) based on both the geographic location of aircraft 12 and the ground speed of aircraft 12. For example, processor 16 may be configured to determine aircraft 12 is outside of a designated ground area in response to determining aircraft 12 is physically located within a geographic location of a designated ground area and the ground speed of aircraft 12 is greater than or equal to the predetermined speed threshold. This set of circumstances may indicate, for example, aircraft 12 is beginning to transition out of a designated ground area, such that the ground obstacle collision alerts may be useful. As another example, in some cases, processor 16 may be configured to determine aircraft 12 is outside of a designated ground area in response to determining aircraft 12 is physically located outside a geographic location of a designated ground area and the ground speed of aircraft 12 is greater than or equal to the predetermined speed threshold. This set of circumstances may indicate, for example, aircraft 12 has transitioned out of the designated ground area, such that the ground obstacle collision alerts may be useful.

As yet another example, processor 16 can be configured to determine aircraft 12 is outside of a designated ground area in response to determining that at least one of aircraft 12 is physically located outside a geographic location of a designated ground area or the ground speed of aircraft 12 is greater than or equal to the predetermined speed threshold.

In response to determining aircraft 12 is still in a designated ground area ("NO" branch of block 36), processor 16 maintains the ground obstacle collision alerting system in a deactivated state in which no alerts are transmitted to a crew of aircraft (34). On the other hand, in response to determining aircraft 12 is no longer in a designated ground area ("YES" branch of block 36), processor 16 reactivates the delivery of the ground obstacle collision alerts (30).

In some examples, in addition to being configured to automatically reactivate the delivery of the ground obstacle collision alerts ("YES" branch of block 36), processor 16 is further configured to reactivate the delivery of ground obstacle collision alerts in response to receiving user input, via user interface 20, indicative of a request to reactivate the delivery of the ground obstacle collision alerts. Processor 16 can receive the user input, for example, while aircraft 12 is in a designated ground area or while aircraft 12 is outside of a designated ground area and, for example, moving at a ground speed less than the predetermined speed threshold at which processor 16 automatically reactivates the delivery of ground obstacle collision alerts.

Configuring system 10 such that a user may manually reactivate the delivery of ground obstacle collision alerts may provide the user with a better sense of control of system 10. However, in contrast to a system that relies on only manual input from a user (e.g., a pilot) to both enable and reenable the ground obstacle collision alerts, system 10 is configured to automatically generate ground obstacle collision alerts when aircraft 12 is outside of a designated ground area. This feature of system 10 may help provide a safeguard against the potential for not reenabling the delivery of ground obstacle collision alerts when the alerts may be desirable.

In addition to, or instead of, reactivating the ground obstacle collision alerts in response to determining aircraft 12 is outside of a designated ground area (36), processor 16 may, in some examples, automatically reactivate the ground obstacle collision alerts in response to determining aircraft 12 is within a particular distance range (e.g., less than or equal to about 100 meters) of a ground area in which the ground obstacle collision alerts may be desirable, such as a runway. Processor 16 can determine the location of the runway or other ground area in which the ground obstacle collision alerts may be desirable using any suitable technique, such as using a database stored by memory 24 or another device that indicates the locations (e.g., using coordinates) of the ground areas.

The techniques of this disclosure may be implemented in a wide variety of computer devices. Any components, modules or units have been described provided to emphasize functional aspects and does not necessarily require realization by different hardware units. The techniques described herein may also be implemented in hardware, software, firmware, or any combination thereof. Any features described as modules, units or components may be implemented together in an integrated logic device or separately as discrete but interoperable logic devices. In some cases, various features may be implemented as an integrated circuit device, such as an integrated circuit chip or chipset.

As mentioned above, the techniques of this disclosure may also be implemented on an article of manufacture comprising a computer-readable storage medium. The computer-readable storage medium comprises computer-readable instructions for execution by a processor. The instructions, when executed by a processor, cause the processor to perform any part of the techniques described herein. The instructions may be, for example, software instructions, such as those used to define a software or computer program. The computer-readable medium may be a computer-readable storage medium such as a storage device (e.g., a disk drive, or an optical drive), memory (e.g., a Flash memory, ROM, or RAM or any other type of volatile or non-volatile memory that stores instructions (e.g., in the form of a computer program or other executable) to cause a programmable processor to perform the techniques described herein. The computer-readable medium is non-transitory in some examples.

The term "processor," as used herein may refer to any of the foregoing structure or any other structure suitable for implementation of the techniques described herein. In addition, in some aspects, the functionality described herein may be provided within dedicated software modules or hardware modules configured for performing the techniques of this disclosure. Even if implemented in software, the techniques may use hardware such as a processor to execute the software, and a memory to store the software. In any such cases, the computers described herein may define a specific machine that is capable of executing the specific functions described herein. Also, the techniques could be fully implemented in one or more circuits or logic elements, which could also be considered a processor.

Various examples have been described. These and other examples are within the scope of the following claims.

What is claimed is:

1. A method comprising:

determining an aircraft on the ground is in a designated ground area;

in response to determining the aircraft on the ground is in the designated ground area, deactivating delivery of ground obstacle collision alerts by a ground obstacle collision alerting system of the aircraft;

after deactivating the delivery of the ground obstacle collision alerts, determining, by a processor, the aircraft is outside of the designated ground area; and reactivating, by the processor, the delivery of the ground obstacle collision alerts in response to determining the aircraft is outside the designated ground area.

2. The method of claim 1, further comprising delivering, by the ground obstacle collision alerting system, the ground obstacle collision alerts, wherein delivering the ground obstacle collision alerts comprises:

detecting, by the processor, a ground obstacle collision condition for the aircraft; and in response to detecting the ground obstacle collision condition, controlling, by the processor, a user interface to deliver a ground obstacle collision alert.

3. The method of claim 1, wherein determining the aircraft is in the designated ground area comprises:

receiving, by the processor, user input; and determining, by the processor, the aircraft is in the designated ground area based on the user input.

4. The method of claim 1, wherein at least one of determining the aircraft is in the designated ground area or determining the aircraft is outside the designated ground area comprises:

determining, by the processor, a geographic location of the aircraft; and determining, by the processor, the aircraft is in the designated ground area or outside the designated ground area based on the geographic location of the aircraft.

5. The method of claim 4, wherein the geographic location of the aircraft comprises a first geographic location, and determining the aircraft is in the designated ground area or outside the designated ground area based on the geographic location of the aircraft comprises:

determining a second geographic location of the designated ground area;

determining the aircraft is in the designated ground area in response to determining the first geographic location of the aircraft overlaps with the second geographic location of the designated ground area; and determining the aircraft is outside the designated ground area in response to determining the first geographic location of the aircraft does not overlap with the second geographic location of the designated ground area.

6. The method of claim 1, wherein deactivating the delivery of the ground obstacle collision alerts comprises suppressing delivery of all ground obstacle collision alerts to a user via a user interface.

7. The method of claim 1, wherein deactivating the delivery of the ground obstacle collision alerts comprises deactivating the delivery of the ground obstacle collision alerts after a predetermined waiting period following a determination, by the processor, that the aircraft is in the designated ground area.

8. The method of claim 1, wherein determining the aircraft is outside of the designated ground area comprises:

determining, by the processor, a ground speed of the aircraft; and determining, by the processor, the aircraft is outside of the designated ground area in response to determining the ground speed of the aircraft is greater than a predetermined speed threshold.

9. The method of claim 1, wherein the designated ground area comprises at least one of a ramp area or a gate area of an airport.

10. A system comprising:

a ground obstacle collision alerting system configured to deliver ground obstacle collision alerts indicative of one or more ground obstacle collision conditions for an aircraft on the ground; and a processor configured to determine the aircraft on the ground is in a designated ground area, control the ground obstacle collision alerting system to deactivate delivery of the ground obstacle collision alerts in response to determining the aircraft is in the designated ground area, after controlling the ground obstacle collision alerting system to deactivate the delivery of the ground obstacle collision alerts, determine the aircraft is outside of the designated ground area, and control the ground obstacle collision alerting system to reactivate the delivery of the ground obstacle collision alerts in response to determining the aircraft outside the designated ground area.

11. The system of claim 10, wherein the ground obstacle collision alerting system comprises the processor.

12. The system of claim 10, further comprising a data source configured to generate data indicative of one or more ground obstacle collision conditions for the aircraft, wherein the ground obstacle collision alerting system is configured to generate and deliver the ground obstacle collision alerts based on the data generated by the data source.

13. The system of claim 10, further comprising a user interface, wherein the processor is configured to determine the aircraft is in the designated ground area by at least receiving, via the user interface, user input indicating the aircraft is in the designated ground area based on the user input.

14. The system of claim 10, wherein the processor is configured to at least one of determine the aircraft is in the designated ground area or determine the aircraft is outside the designated ground area by at least determining a geographic location of the aircraft and determining the aircraft is in the designated ground area or outside the designated ground area based on the geographic location.

15. The system of claim 14, wherein the geographic location of the aircraft comprises a first geographic location, and the processor is configured to determine the aircraft is in the designated ground area or outside the designated ground area based on the geographic location of the aircraft by at least determining a second geographic location of the designated ground area, determining the aircraft is in the designated ground area in response to determining the first geographic location of the aircraft overlaps with the second geographic location of the designated ground area, and determining the aircraft is outside the designated ground area in response to determining the first geographic location of the aircraft does not overlap with the second geographic location of the designated ground area.

16. The system of claim 15, further comprising a memory that stores a database of geographic locations of a plurality of designated ground areas, wherein the processor is configured to determine the second geographic location based on the database.

17. The system of claim 10, wherein the processor is configured to control the ground obstacle collision alerting system to deactivate the delivery of the ground obstacle collision alerts after a predetermined waiting period following a determination, by the processor, that the aircraft is in the designated ground area.

18. The system of claim 10, wherein the processor is configured to determine the aircraft is outside of the designated ground area by at least determining a ground speed of the aircraft and determining the aircraft is outside of the designated ground area in response to determining the ground speed of the aircraft is greater than a predetermined speed threshold.

19. The system of claim 10, further comprising a user interface, wherein the processor is further configured to receive user input via the user interface and at least one of deactivate or reactivate delivery of the ground obstacle collision alerts in response to receiving the user input.

20. A system comprising:

means for determining an aircraft on the ground is in a designated ground area;

means for deactivating delivery of ground obstacle collision alerts by a ground obstacle collision alerting system of the aircraft in response to determining the aircraft on the ground is in the designated ground area;

means for determining the aircraft is outside of the designated ground area after deactivating the delivery of the ground obstacle collision alerts; and means for reactivating the delivery of the ground obstacle collision alerts in response to determining the aircraft is outside the designated ground area.

* * * * *